United States Patent [19]

Cobb

[11] Patent Number: 4,492,020

[45] Date of Patent: Jan. 8, 1985

[54] METHOD FOR FABRICATING CORRUGATED MICROWAVE COMPONENTS

[75] Inventor: Jack M. Cobb, San Juan Capistrano, Calif.

[73] Assignee: Hughes Aircraft Company, El Segundo, Calif.

[21] Appl. No.: 414,222

[22] Filed: Sep. 2, 1982

[51] Int. Cl.[3] ..... H01P 11/00; H01Q 13/02

[52] U.S. Cl. ..... 29/600; 29/445; 29/DIG. 12; 29/DIG. 16; 29/DIG. 26; 333/239

[58] Field of Search ..... 29/600, 445, DIG. 12, 29/DIG. 16, DIG. 26; 333/239, 242, 248, 208

[56] References Cited

U.S. PATENT DOCUMENTS

| | | | |
|---|---|---|---|
| 2,761,828 | 9/1956 | Eldredge | 204/9 |
| 2,785,382 | 3/1957 | Lamb | 29/600 |
| 2,793,989 | 5/1957 | Goodman et al. | 29/600 |
| 2,872,650 | 2/1959 | Winkler | 333/239 |
| 3,070,873 | 1/1963 | Gordon et al. | 29/600 |
| 3,103,454 | 9/1963 | Scrapple et al. | 29/600 X |
| 3,105,285 | 10/1963 | Favre | 29/600 |
| 3,192,609 | 7/1965 | Murata et al. | 29/600 |
| 3,261,078 | 7/1966 | Hanemann, Jr. et al. | 29/600 |
| 3,327,371 | 6/1967 | Kerns et al. | 29/600 |
| 3,772,619 | 11/1973 | Clarricoats | 333/242 |
| 3,845,422 | 10/1974 | Rhodes | 333/208 |
| 3,969,814 | 7/1976 | Toy et al. | 29/600 |
| 4,270,253 | 6/1981 | Herb et al. | 29/445 X |
| 4,408,208 | 10/1983 | Dumas | 343/786 |

FOREIGN PATENT DOCUMENTS

| | | | |
|---|---|---|---|
| 1188214 | 3/1965 | Fed. Rep. of Germany | 29/600 |
| 2947245 | 5/1981 | Fed. Rep. of Germany | 29/600 |
| 2947246 | 5/1981 | Fed. Rep. of Germany | 29/600 |
| 1462893 | 12/1966 | France . | |
| 2414256 | 8/1979 | France . | |
| 0168402 | 12/1981 | Japan | 29/600 |
| 0168403 | 12/1981 | Japan | 29/600 |

OTHER PUBLICATIONS

Dragone, "Characteristics of a Broadband Microwave Corrugated Feed: A Comparison Between Theory and Experiment", *The Bell System Technical Journal*, vol. 56, No. 6, Jul.-Aug. 1977, pp. 869-888.

*Primary Examiner*—Charlie T. Moon
*Assistant Examiner*—Ronald S. Wallace
*Attorney, Agent, or Firm*—Thomas A. Runk; A. W. Karambelas

[57] ABSTRACT

In the disclosed method for fabricating corrugated microwave components, a billet assembly is formed of electrically conductive plates sandwiched with chemical etching sensitive spacer material and clamped together. An inside surface is formed in the billet and a mandrel inserted. An outer contoured surface is then formed on the mandrel-billet assembly. The outer surface is then plated to a desired thickness. The mandrel is removed and the spacers chemically etched away leaving the finished component. With the disclosed method, microwave device fabrication for frequencies including 100 GHz and higher is possible.

11 Claims, 10 Drawing Figures

METHOD FOR FABRICATING CORRUGATED MICROWAVE COMPONENTS

BACKGROUND OF THE INVENTION

1. Field of the Invention

This invention relates to the fabrication of microwave components and specifically to the fabrication of corrugated or ridged microwave components.

2. Description of the Prior Art

Corrugated or ridged feeds, horns, waveguide sections, filters and other devices are useful in a wide variety of microwave applications. These corrugated devices are difficult to fabricate with accuracy and the higher their frequency of operation, the more difficult it is to obtain the required accuracy. At frequencies exceeding approximately 10 GHz, dimension control of fins, fin spacing and wall thicknesses become difficult and costly. Furthermore, weight of the microwave device becomes a factor of importance in certain applications, such as in satellite communications.

A prior art method for fabricating corrugated horns was electroforming on a mandrel. The mandrel would have the desired taper and slots for fins and after the electroforming of the device onto the mandrel was completed, the mandrel would be removed by chemical etching. This method is in many cases satisfactory for operational frequencies lower than approximately 10 GHz. Above the frequency, accurate fin thickness is difficult to obtain in the mandrel due to the small size of the fins. Also the fin depth is restricted since structurally, the mandrel could only be slotted to a certain depth. Due to these mechanical restrictions, the fin width of depth ratio is limited and this limits the maximum frequency of operation. Since the mandrel was chemically etched away it is not reusable thus adding to the cost of fabrication. Also, the etching process can be lengthy which adds to the cost and lessens the ease of manufacture.

A second method of fabrication used in the prior art is casting. This method has found little application in the higher frequency ranges since required accuracy is extremely difficult or impossible to obtain. Above approximately 10 GHz, it is extremely difficult to obtain the small fin width required. Also, casting molds are relatively expensive.

Another prior art fabrication method is presented in the article entitled: "Characteristics of a Broadband Microwave Corrugated Feed: A Comparison Between Theory and Experiment," by Dragone in *The Bell System Technical Journal*, Vol. 56, No. 6, July-August 1977, pages 869 to 888. This method is claimed to be a novel fabrication technique usuable at very high frequencies, as high as 100 GHz (page 887). According to this article, a block of sandwiched aluminum and brass disks is assembled. Then an outer surface is machined and a wall of metal is electroplated onto this surface. Then an inner surface is machined. After that machining, the aluminum is removed with a solvent, thus leaving the final product, a corrugated horn. The article analyzes the performance of a feed made in accordance with this fabrication technique at frequencies ranging from 17 GHz to 35 GHz (page 871).

Although it is claimed that a horn operable as high as 100 GHz may be constructed using Dragone's process, (page 887) there are several disadvantages. Because the outside surface is formed and plated first, this plating must be strong enough to support the subsequent machining of the inside surface. Thus a relatively thick plating is necessary, which increases both the weight and size of the corrugated horn. Also, using Dragone's process, horn throat sections, flanges or transitions must be internally machined at the same time as the inner surface. This technique becomes physically difficult or impracticable at frequencies above approximately 20 GHz due to very small apertures and required very close tolerances.

It is a purpose of the invention to provide a simple and reliable method for fabricating corrugated microwave components with a lower manufacturing cost than prior art methods.

It is also a purpose of the invention to provide a method for fabricating corrugated microwave components where more accurate dimension control is possible than prior art methods.

It is also a purpose of the invention to provide a method for fabricating corrugated microwave components where the component can be made lighter than prior art methods permitted.

It is also a purpose of the invention to provide a method for fabricating corrugated microwave components where the fabrication may be completed faster than with prior art methods.

It is also a purpose of the invention to provide a method for fabricating corrugated microwave components which are usable at high frequencies including and exceeding the 100 GHz frequency range.

It is also a purpose of the invention to provide a method for fabricating corrugated microwave components where preconstructed components such as throat sections, flanges or transitions may be added thereby providing an integrated assembly.

SUMMARY OF THE INVENTION

The above purposes and additional purposes are accomplished by the invention wherein corrugated microwave components are fabricated in accordance with the basic steps as described below.

In the basic method of the invention, a set of plates of predetermined thickness separated by spacers of predetermined thickness is clamped together. This sandwich billet has the inside surface, which will be the depth of the fins of the microwave component, formed in it. A mandrel is formed with the same taper as the inside surface and is inserted into that surface in order to provide disk clamping and support for subsequent fabrication steps. Preconstructed components such as flanges, transition sections, etc. may be added to the billet as desired. The outside surface of the microwave component is then formed to the desired contour. The contoured billet with the added preconstructed components, if any, is then plated on the outside to the desired plating wall thickness. The mandrel is constructed so that it prevents plating from reaching the inside surface. After plating, the mandrel is removed and the spacers are chemically etched away leaving the complete corrugated microwave component.

The novel features which are believed to be characteristic of the invention together with further purposes and advantages will be better understood from the following description considered in connection with the accompanying drawings.

DETAILED DESCRIPTION OF THE INVENTION

Figure 1:
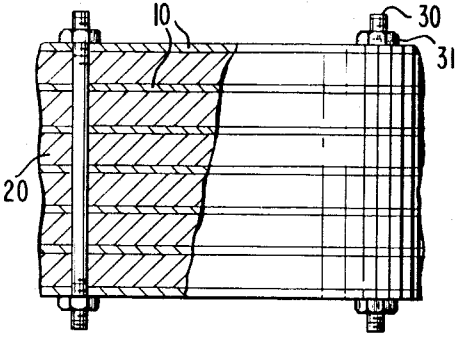

Referring to the drawings with greater particularity, in FIG. 1 there is shown a block assembly or sandwich billet which consists of alternating materials clamped together. In the embodiment shown in FIG. 1, plates 10 are sandwiched next to spacers 20. Any suitable material may be chosen for the plates 10 including copper, brass, gold, silver, etc. and they may be in any shape depending upon manufacturing conveniences. Disks are used here for convenience of explanation. The thickness of disks 10 will be the fin thickness and the thickness of spacers 20 will determine the fin spacing after these spacers are later removed. Likewise, the material of the spacers is arbitrary, however, it should be of a material which can easily be removed with chemical etching, such as aluminum, as will be further discussed later. Rods 30 with nuts 31 clamp the sandwiched materials together in order to support subsequent fabrication steps. Other clamping methods known in the art may be substituted for rods 30 and nuts 31.

Figure 2:
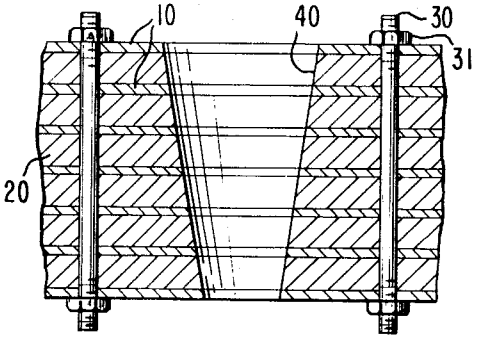

In FIG. 2, an inside surface 40 is formed into the billet. This inside surface defines the spacing between the tops of the fins and its dimensions are chosen in accordance with required electrical performance. A tapered surface is shown in FIG. 2 however the degree of taper, if any, is likewise in accordance with required electrical performance. This surface may be fabricated by installing the billet in a lathe and machining this inside surface. The use of a lathe and the method of forming the surface by machining are used here for explanation only: other methods known in the art such as broaching may be used to fabricate inside surface 40. Machining is used here since it is known that very accurate dimension control may be obtained through its use.

Alternatively, an inside surface could have been formed in the individual plates and spacers before sandwiching. In that case, only a shaping of that surface may be required later.

Figure 3:
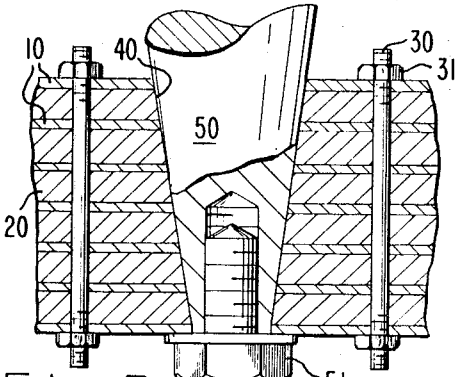
FIGS. 1, 2, 3, 4, 5, 6, 7 and 8 illustrate the cross-sections of waveguide horn structures at successive stages of fabrication according to the basic method of the invention. Cross-sections of horn structures resulting from the fabrication method in accordance with the invention are illustrated in FIGS. 7 and 8.

A mandrel 50 is then fabricated by machining or other suitable method and has the same taper and size as inside surface 40. This mandrel 50 is then inserted into inside surface 40 as shown in FIG. 3. In this embodiment, the purpose of the mandrel 50 is to provide disk clamping support for subsequent fabrication steps. Clamp 51 and the taper of the mandrel 50 clamp the billet together. The mandrel 50 has a second purpose relevant to the subsequent plating step. The mandrel prevents the plating of inside surface 40. This mandrel is reusable and can be made of any suitable material such as stainless steel, aluminum, etc. Because it is reusable, manufacturing costs are correspondingly lowered and repeatability of results is correspondingly raised.

Figure 6:
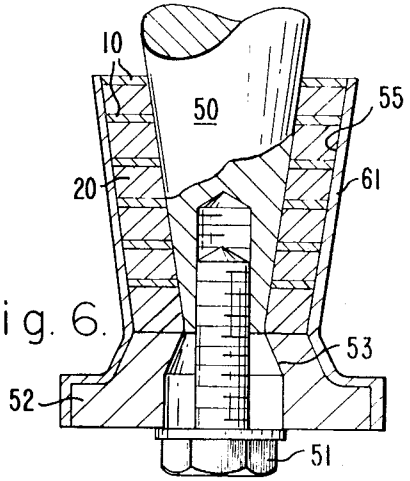

One of the advantages of the invention is that preconstructed additional sections may be added to the device under construction. As is shown in FIG. 6, a flange 52 and throat section 53 have been added to the billet. They may be temporarily secured in place to the billet by clamp 51 which is threaded into mandrel 50. Other methods known in the art may be used to secure flange 52 to the billet. Thus the invention avoids the problem of internally machining the throat section as pointed out in the Dragone process.

Figure 4:
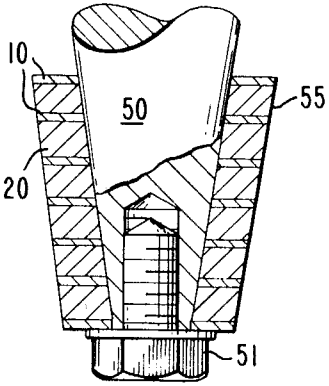
Figure 8:
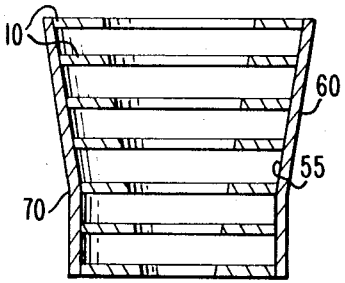

In FIG. 4, outside surface 55 is formed. The contour of this surface determines fin depth, operation frequency, and other electrical parameters. As is shown in FIG. 8, a matching section 70 with associated greater fin depth may be fabricated. The contouring of this section 70 would occur in this step.

Figure 5:
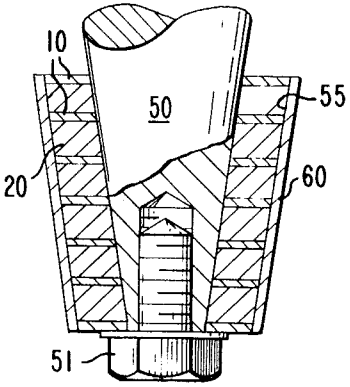

In FIG. 5, outer surface 55 is plated to the desired plating wall thickness 60. Electroforming a copper plating is one method and one material which will accomplish this step. Other materials may be plated onto outer surface 55 such as gold, silver, nickel, etc. In addition, multiple layers of plating of different materials may be applied such as a first layer of copper and a second layer of nickel to add strength. Because of the invention, this plating 60 can be kept to a small thickness. The environmental requirements of the application such as shock, vibration, etc. will determine the actual thickness of the plating along with strength necessary to support the fins 10. In the Dragone process, this plating wall 60 must be thick enough to also support a subsequent step of machining the inside surface. The thickness required to support this machining step causes a much thicker wall than one obtained by use of the invention. This added thickness increases both the weight and the size of the product. In satellite, missile and many other applications, both weight and size can be of critical importance. As another example, where the end product is a waveguide horn and it is to be used in a planar array antenna with possibly 100 other identical horns, minimum weight and size and desired characteristics.

In FIG. 6, it is also shown that an additional component, if any, is also plated 61 along with outside surface 55, thus resulting in an integrated assembly. In this embodiment, flange 52 with throat section 53 have been integrated. As can be seen, the invention solves the previously discussed prior art problem of difficult or impractical internal machining of such throat sections for high-frequency devices. The formation of the throat section 53 was accomplished before it was integrated with the horn section. Likewise, matching sections and other transition sections may be preformed before integration.

Figure 7:
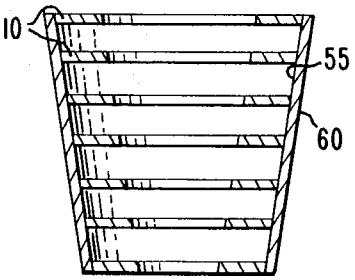

In FIG. 7 it is shown that the mandrel 50 has been removed and spacers 20 have been removed. The spacers 20 have been chemically etched away in order to remove them thus leaving the completed horn.

In FIG. 8, also there is shown a completed horn with a matching section 70 formed by contouring the outside surface 55 as previously discussed. The angle of section 70 and its dimensions vary as dictated by performance requirements.

Figure 10:
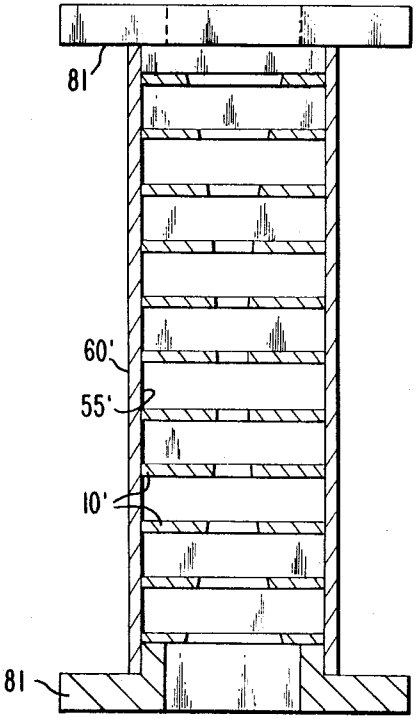
FIG. 10 is a cross-section view of a corrugated waveguide filter with flanges assembly which was fabricated in accordance with the basic method of the invention.
Figure 9:
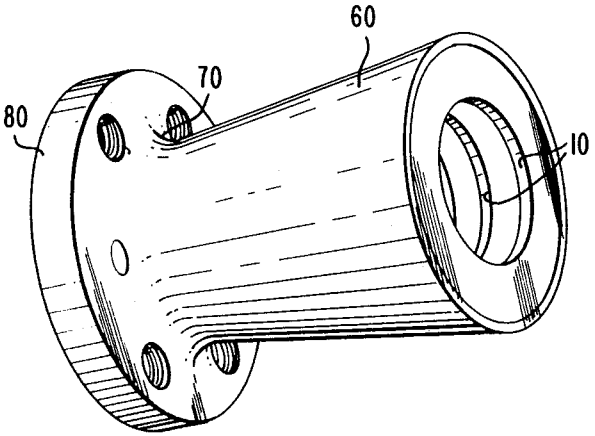
FIG. 9 is a perspective view of a corrugated horn structure and flange assembly which was fabricated in accordance with the basic method of the invention.

FIG. 9 presents an assembly of a horn structure fabricated in accordance with the invention, having fins 10, plated surface 60 and a matching section 70. The horn structure is connected to flange 80. The invention is applicable to a variety of microwave devices where corrugation is desired. For example, corrugated filters, phase shifters and waveguide sections along with the example used above, the horn structure, may all be fabricated with use of the invention. A corrugated waveguide filter fabricated in accordance with the invention is presented in FIG. 10. It, likewise, has fins 10', outside surface 55', plating 60' and two integrated flanges 81. It should be noted that a mandrel differing in shape from that shown previously would be required to fabricate this embodiment, however, this does not depart from the scope of the invention.

A microwave horn with an integrated transition section and flange similar to that shown in FIG. 9 was constructed. The frequency of operation was 94 GHz and the embodiment operated successfully.

Although the invention has been shown and described with respect to specific methods and devices, nevertheless, various changes and modifications obvious to one skilled in the art to which the invention pertains are deemed to lie within the purview of the invention.

What is claimed is:

1. A method for fabricating corrugated microwave components, said method comprising the steps of:

sandwiching a plurality of layers of chemically removable spacer material alternately with electrically conductive plates which are movable in relation to each other to form a billet, the billet having an outside surface;

clamping the layers of the billet to prevent relative movement thereof with a first clamping means disposed adjacent and inwardly of the outside surface;

forming a tapered hole through the billet;

inserting in said hole a mandrel having substantially the same taper as the hole and a maximum diameter greater than that of the hole;

adjusting a second clamping means operatively secured to the small end of the tapered mandrel for urging the layers towards the large end of the mandrel so as to clamp the plates and the spacer material in fixed positions relative to each other;

then reshaping the outside surface of said billet and removing the first clamping means;

plating said reshaped outside surface with an electrically conductive material to form a connecting means between the electrically conductive plates;

removing said mandrel and second clamping means; and chemically removing said spacer material.

2. The method as recited in claim 1 wherein said mandrel is shaped such that its insertion into said hole prevents plating of the said hole.

3. The method as recited in claim 1 further comprising the step of abutting a preconstructed component to said billet before said step of adjusting a second clamping means, and wherein said step of adjusting a second clamping means comprises abutting the second clamping means against the preconstructed component to urge it into contact with the layers and towards the large end of the mandrel so as to clamp the preconstructed component and the layers in fixed positions relative to each other, and further, wherein said step of plating said reshaped outside surface comprises plating said reshaped outside surface and said preconstructed component with an electrically conductive material to form a connecting means between the electrically conductive plates and the preconstructed component.

4. The method as recited in claim 3 wherein said step of reshaping the outside surface also comprises shaping the outside surface of the preconstructed component.

5. The method as recited in claim 4 wherein said hole is formed by machining.

6. The method as recited in claim 5 wherein said outside surface is formed by machining.

7. The method as recited in claim 1 further comprising a step of abutting a preconstructed component to the billet before the step of adjusting a second clamping means, and wherein the step of adjusting a second clamping means comprises clamping the preconstructed component and the layers in fixed positions relative to each, and further, wherein the step of plating said reshaped outside surface with an electrically conductive material comprises plating said reshaped outside surface and said preconstructed component with an electrically conductive material to form a connecting means between the electrically conductive plates and the preconstructed component.

8. A method for fabricating corrugated microwave components, said method comprising the steps of:

sandwiching a plurality of layers of electrically conductive plates alternately with chemically removable spacer material which are movable in relation to each other to form a billet, the billet having an outside surface;

clamping the layers of the billet to prevent relative movement thereof with a first clamping means disposed adjacent and inwardly of the outside surface;

forming a tapered hole through the billet;

abutting a preconstructed component against the billet;

inserting into the hole and into the preconstructed component a mandrel having substantially the same taper as the hole and a maximum diameter greater than that of the hole;

adjusting a second clamping means operatively secured to the small end of the tapered mandrel for urging the preconstructed component and the layers towards the large end of the mandrel so as to clamp the preconstructed component and the layers in fixed positions relative to each other;

then reshaping the outside surface of said billet and removing the first clamping means;

plating said reshaped outside surface and the preconstructed component with an electrically conductive material to form a connecting means between the preconstructed component and the plates;

removing said mandrel and second clamping means; and chemically removing said spacer material.

9. The method as recited in claim 8 wherein said mandrel is shaped such that its insertion into said hole prevents plating of said hole.

10. The method as recited in claim 8 wherein said step of reshaping the outside surface also comprises shaping the outside surface of the preconstructed component.

11. A method for fabricating corrugated microwave components, said method comprising:

a first step of sandwiching a plurality of layers of electrically conductive plates alternately with chemically removable spacer material which are movable in relation to each other to form a billet, the billet having an outside surface;

a second step of clamping the layers of the billet to prevent relative movement thereof with a first clamping means disposed adjacent and inwardly of the outside surface;

a third step of forming a tapered hole through said billet;

a fourth step of inserting into the hole a mandrel having substantially the same taper as the hole and a maximum diameter greater than that of the hole:

a fifth step of adjusting a second clamping means operatively secured to the small end of the tapered mandrel for urging the layers towards the large end of the mandrel so as to clamp the plates and the spacer material in fixed position relative to each other;

a sixth step of reshaping the outside surface of said billet and removing the first clamping means;

a seventh step of plating said reshaped outside surface with an electrically conductive material to form a connecting means between the electrically conductive plates;

an eighth step of removing said mandrel and second clamping means; and a ninth step of chemically removing said spacer material.

* * * * *